US008277263B1

(12) United States Patent
Smith

(10) Patent No.: US 8,277,263 B1
(45) Date of Patent: Oct. 2, 2012

(54) INTERSYSTEM GROUNDING BRIDGE

(75) Inventor: Lawrence J. Smith, Stamford, CT (US)

(73) Assignee: Bridgeport Fittings, Inc., Stratford, CT (US)

( * ) Notice: Subject to any disclaimer, the term of this patent is extended or adjusted under 35 U.S.C. 154(b) by 0 days.

(21) Appl. No.: 13/134,580

(22) Filed: Jun. 9, 2011

(51) Int. Cl.
*H01R 4/32* (2006.01)

(52) U.S. Cl. ..... 439/779; 439/798

(58) Field of Classification Search ..... 439/778–780, 439/810–814, 794–798
See application file for complete search history.

(56) References Cited

U.S. PATENT DOCUMENTS

| | | | | |
|---|---|---|---|---|
| 2,748,365 | A | 5/1956 | Speck | |
| 3,125,398 | A * | 3/1964 | Wolf | 439/798 |
| 3,133,779 | A | 5/1964 | Stanback | |
| 3,794,963 | A | 2/1974 | Cooper, Jr. | |
| 4,231,633 | A | 11/1980 | Luke et al. | |
| 4,382,651 | A * | 5/1983 | Klosin et al. | 439/359 |
| 5,236,377 | A * | 8/1993 | Goto | 439/779 |
| 5,494,462 | A | 2/1996 | Auclair | |
| 5,690,516 | A * | 11/1997 | Fillinger | 439/798 |
| 5,848,913 | A | 12/1998 | Ashcraft | |
| 5,931,708 | A * | 8/1999 | Annas et al. | 439/798 |
| 6,579,131 | B1 * | 6/2003 | Ashcraft et al. | 439/798 |
| 6,664,469 | B1 * | 12/2003 | Sweeney | 174/51 |
| 6,769,941 | B2 * | 8/2004 | Norden | 439/798 |
| 6,939,183 | B2 | 9/2005 | Ferretti et al. | |
| 7,056,163 | B2 * | 6/2006 | Hay | 439/810 |
| 7,134,921 | B2 | 11/2006 | Siracki et al. | |
| D536,229 | S | 2/2007 | Clark et al. | |
| 7,175,484 | B1 * | 2/2007 | Tamm et al. | 439/798 |
| 7,223,132 | B2 * | 5/2007 | King et al. | 439/778 |
| 7,281,932 | B2 | 10/2007 | Cheng et al. | |
| 7,416,454 | B2 * | 8/2008 | Tamm et al. | 439/798 |
| 7,473,147 | B2 * | 1/2009 | Zahnen | 439/798 |
| 7,507,126 | B2 * | 3/2009 | King et al. | 439/778 |
| 7,537,467 | B1 * | 5/2009 | Gretz | 439/108 |
| 7,591,656 | B1 * | 9/2009 | Gretz | 439/108 |
| 7,677,932 | B2 * | 3/2010 | King et al. | 439/778 |
| 7,942,679 | B1 * | 5/2011 | Gretz | 439/108 |
| 7,963,811 | B2 * | 6/2011 | Wason et al. | 439/798 |
| 7,988,503 | B2 * | 8/2011 | King et al. | 439/778 |
| 2004/0067697 | A1 * | 4/2004 | Zahnen | 439/798 |

(Continued)

OTHER PUBLICATIONS

Ilsco; Ilsco ClearChoice Connectors; Advertisement for ClearGround Intersystem Bonding in IECI magazine; Sep./Oct. 2009; p. 37.

(Continued)

*Primary Examiner* — Ross Gushi
(74) *Attorney, Agent, or Firm* — Ware, Fressola, Van Der Sluys & Adolphson LLP

(57) ABSTRACT

An intersystem grounding bridge has an elongated housing made from electrically conductive material, the housing including a plurality of channels spaced along a longitudinal axis thereof, the channels for receiving a grounding wire/conductor associated with a communication system component. The housing has a plurality of corresponding threaded apertures dimensioned for receipt of set screws for securing a grounding wire/conductor inserted in a corresponding channel. The intersystem grounding bridge includes a split bolt portion extending substantially in line with the elongated axis of the housing and having an open ended slot formed therein dimensioned for receiving a grounding rod/conductor, the split bolt portion having threads formed thereon for receiving a threaded fastener for securing the grounding rod/conductor to the split bolt portion. A pressure bar having a bottom portion dimensioned for contacting the grounding rod/conductor in the split bolt portion may also form part of the grounding bridge.

29 Claims, 5 Drawing Sheets

U.S. PATENT DOCUMENTS

| | | | | |
|---|---|---|---|---|
| 2004/0087220 | A1* | 5/2004 | Norden | 439/798 |
| 2005/0202732 | A1* | 9/2005 | Rizzo et al. | 439/810 |
| 2006/0063437 | A1* | 3/2006 | Hay | 439/810 |
| 2006/0183382 | A1* | 8/2006 | King et al. | 439/798 |
| 2007/0167087 | A1* | 7/2007 | Tamm et al. | 439/798 |
| 2007/0207682 | A1* | 9/2007 | Zahnen | 439/798 |
| 2007/0249239 | A1* | 10/2007 | Tamm et al. | 439/798 |
| 2008/0076306 | A1* | 3/2008 | Zahnen | 439/798 |
| 2008/0146089 | A1* | 6/2008 | Bundren | 439/798 |
| 2009/0088032 | A1* | 4/2009 | Keeven et al. | 439/797 |
| 2009/0163087 | A1* | 6/2009 | Sweeney et al. | 439/798 |
| 2011/0034090 | A1* | 2/2011 | King et al. | 439/778 |
| 2011/0237140 | A1* | 9/2011 | Cerasale | 439/797 |
| 2012/0088380 | A1* | 4/2012 | Smith | 439/100 |

OTHER PUBLICATIONS

Erico International Corporation; Instruction Sheet for Intersystem Bonding Termination; 2008; pp. 1-2.

Bumdy; Advertisement for Bumdy Bondit Intersystem Bonding; 2009 FCI USA, Inc.

Erico International Corporation; Brochure entitled: "Intersystem Bonding Termination for Residential and Small Commercial Facilities"; 2009; whole document.

Arlington Industries, Inc.; Advertisement for a Grounding Bridge in publication entitled "Electrical Contractor Magazine"; Aug. 2009; p. 125.

* cited by examiner

INTERSYSTEM GROUNDING BRIDGE

TECHNICAL FIELD

The present invention relates to electrical connectors and more particularly to electrical clamps or connectors constructed for bonding and securely grounding communication systems directly with a grounding rod/conductor.

BACKGROUND OF THE INVENTION

In the field of wiring homes and buildings, whether for new construction or for improvements or expansion, substantial development and product improvements have been made. Typically, these improvements are directed to enabling installers to securely and safely mount any desired wiring to any desired location in the most efficient and quickest manner.

In any particular installation or location, various conduits or cables must be interconnected to each other as well as connected to the primary power supply in a suitable power distributing outlet box, junction box, meter box, or other enclosure. In these instances, flexible metal conduit and/or armor or metalclad cables within which the electrical power carrying wires are contained, must be securely mounted to the housing of a junction box or outlet box, or connected to an appropriate solid or rigid metal tubing or conduit.

In addition, in order to assure that the installed conduits or cables and the electrical power carrying wires contained therein are properly and safely installed for operation, power distributing outlet boxes, junction boxes, meter boxes, and other similar enclosures typically incorporate grounding conductors which are interconnected to the power supply and extend from the particular box to a properly installed grounding rod/conductor or remote grounded location. In this way, all of the power carrying wires installed in the particular home or building are properly connected to a grounded location.

In 2008, various Articles of the National Electric Code (NEC) were rewritten to define new requirements for Intersystem Bonding Termination. In this regard, requirements for installing a bonding connection point for communication systems were specifically defined. Due to the numerous instances in which homes, electrical systems, electronic equipment, communication equipment, and the like were destroyed or severely damaged by uncontrolled events such as lightning, power surges, etc., the new requirements were established to provide an effective and reliable intersystem bonding termination which should reduce or eliminate the difficulties and damage that has been encountered.

In accordance with the new requirements, the intersystem bonding termination establishes a device which provides a connecting point for communication grounding and bonding systems to the electrical service equipment. In achieving this goal, the intersystem bonding terminations must employ either (1) a set of terminals mounted and electrically connected to the meter enclosure, (2) a bonding bar near the service or meter equipment and closure or close to the raceway for the service conductors, or (3) the installation of a bonding bar near the grounding electrode conductor.

Although these requirements have been in existence for several years, commercially available products which are capable of achieving the desired mounted connections are both limited and expensive. Typically, these prior art products incorporate components which are expensive to manufacture due to tolerance requirements for enabling these components to be secured to the desired grounding rod/grounding conductor. Consequently, a need exists in the industry for the production of effective products, such as bonding bars or grounding bridges, which are capable of being employed to satisfy the requirements for the intersystem bonding termination and are capable of being manufactured inexpensively, while also providing a high quality, highly effective and easily employed product.

Therefore, it is a principal object of the present invention to provide an intersystem grounding bridge which is capable of being easily installed in any desired location for being secured to a grounding rod or grounding electrode conductor by incorporating of a split-bolt portion forming part of an elongated housing of an intersystem grounding bridge.

A further object of the present invention is an intersystem grounding bridge with an elongated housing which includes a plurality of apertures, each for receipt of a grounding wire/conductor associated with a communication system component.

Another object of the present invention is to provide an intersystem grounding bridge having the characteristic features described above which is manufactured from easily produced components, thereby achieving a safe, effective, and cost efficient product.

Another object of the present invention is to provide an intersystem grounding bridge having the characteristic features described above which virtually eliminates complicated installation techniques and achieves an easily installed product which is capable of being used by individuals having widely varied experiences.

Another object of the present invention is to provide an intersystem grounding bridge having the characteristic features described above which enables the entire assembly and mounted engagement to be achieved quickly and easily by a single individual.

A further object of the present invention is an intersystem grounding bridge which further incorporates a protective structure that effectively covers the electrically conductive elongated housing to which the grounding wires/conductors of communication system components and the grounding rod/conductor are installed.

Other and more specific objects will in part be obvious and well in part appear hereinafter.

SUMMARY OF THE INVENTION

An embodiment of the present invention is an intersystem grounding bridge comprising an elongated housing formed from electrically conductive material, the housing having a plurality of channels formed therein spaced along an elongated axis of the housing, each channel of the plurality of channels dimensioned for receiving and holding a grounding wire/conductor associated with a communication system component; a plurality of threaded apertures, each threaded aperture of the plurality of threaded apertures in cooperating association with one of the channels and dimensioned for receiving a threaded set screw for enabling the set screw to be advanced into securing engagement with a grounding wire/conductor inserted in the channel, and a split bolt portion extending substantially in line with the elongated axis of the housing, the split bolt portion having an open ended slot formed therein dimensioned for receiving a grounding rod/conductor and further having threads formed on an outer surface thereof dimensioned for receiving a threaded fastener for enabling the fastener to secure a grounding rod/conductor to the split bolt portion.

Another embodiment of the present invention is an intersystem grounding bridge as described above, further comprising a pressure bar having a bottom portion with an outer surface dimensioned for contacting a grounding rod/conductor in the slot of the split bolt portion, the pressure bar dimensioned for fitting within a fastener so as to securely fasten a grounding rod/conductor within the slot of the split bolt portion.

A still further embodiment of the present invention is an intersystem grounding bridge as described above wherein the elongated housing further comprising a plurality of feet attached to a bottom wall of the elongated housing so as to be in the same plane as the bottom wall, each foot having an aperture dimensioned for receipt of a fastener so as to allow securement of the intersystem grounding bridge to a structure.

Another embodiment of the present invention is an intersystem grounding bridge as described above further comprising a protective structure having a mounting plate dimensioned for contact with the bottom wall of the elongated housing, and a cover flexibly secured to the bottom plate, the cover including a top wall and first and second side walls, each side wall having a plurality of cutouts formed therein so as to allow grounding rods/conductors inserted in the elongated housing to pass through at least some of said cutouts when the flexible cover is positioned so that its side walls are adjacent the mounting plate of the housing structure and its top wall is positioned over the elongated housing.

A further embodiment of the present invention is an intersystem grounding bridge as described above wherein the mounting plate of the protective structure has a pair of upstanding flexible tabs.

Another embodiment of the present invention is an intersystem grounding bridge, wherein the mounting plate of the protective structure has a pair of upstanding flexible tabs.

A further embodiment of the present invention is an intersystem grounding bridge as described above, wherein the mounting plate of the protective structure includes apertures formed therein for alignment with the apertures formed in the feet of the elongated housing so as to secure both the mounting plate and the elongated housing to a structure.

A still further embodiment of the present invention is an intersystem grounding bridge as described above, wherein the cover includes a pair of extending members formed on opposite faces of the cover, each extending member defining a passageway therethrough that is dimensioned for passage of one of the flexible tabs of the mounting plate therethrough, thereby allowing the cover to be secured to the mounting plate when positioned over the elongated housing.

Another embodiment of the present invention is an intersystem grounding bridge as described above, wherein the protective structure is made from a non-conductive material, such as a thermoplastic material.

A still further object of the present invention is an intersystem grounding bridge comprising an elongated housing formed from electrically conductive material, the housing having a plurality of channels formed therein spaced along an elongated axis of the housing, each channel of the plurality of channels dimensioned for receiving and holding a grounding wire/conductor associated with a communication system component; a plurality of threaded apertures, each threaded aperture of the plurality of threaded apertures in cooperating association with one of the channels and dimensioned for receiving a threaded set screw for enabling the set screw to be advanced into securing engagement with a grounding wire/conductor inserted in the channel, and a split bolt portion extending substantially in line with the elongated axis of the housing, the split bolt portion having an open ended slot formed therein dimensioned for receiving a grounding rod/conductor and further having threads formed on an outer surface thereof dimensioned for receiving a threaded fastener; and further comprising a protective structure having a mounting plate dimensioned for contact with the bottom wall of the elongated housing, and a cover flexibly secured to the bottom plate, the cover including a top wall and first and second side walls, each side wall having a plurality of cutouts formed therein so as to allow grounding rods/conductors inserted in the elongated housing to pass through at least some of said cutouts when the flexible cover is positioned so that its side walls are adjacent the mounting plate of the housing structure and its top wall is positioned over the elongated housing.

A further embodiment of the present invention is an intersystem grounding bridge of the type described above further comprising a pressure bar having a bottom portion with an outer surface dimensioned for contacting a grounding rod/conductor in the slot of the split bolt portion, the pressure bar dimensioned for fitting within a fastener so as to securely fasten a grounding rod/conductor within the slot of the split bolt portion.

A still further embodiment is an intersystem grounding bridge as described above, wherein the elongated housing further comprises a plurality of feet attached to a bottom wall of the elongated housing so as to be in the same plane as the bottom wall, each foot having an aperture dimensioned for receipt of a fastener so as to allow securement of the intersystem grounding bridge to a structure.

DETAILED DESCRIPTION

Figure 1:
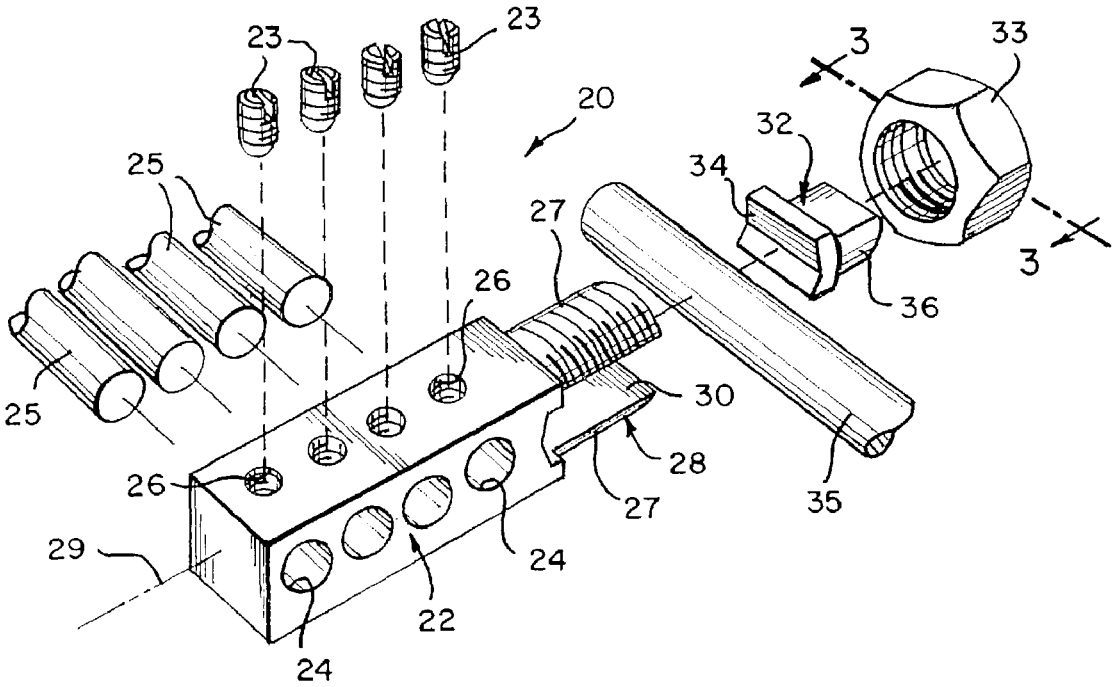
FIG. 1 is an exploded perspective view of an intersystem grounding bridge according to a first embodiment of the present invention.
Figure 2:
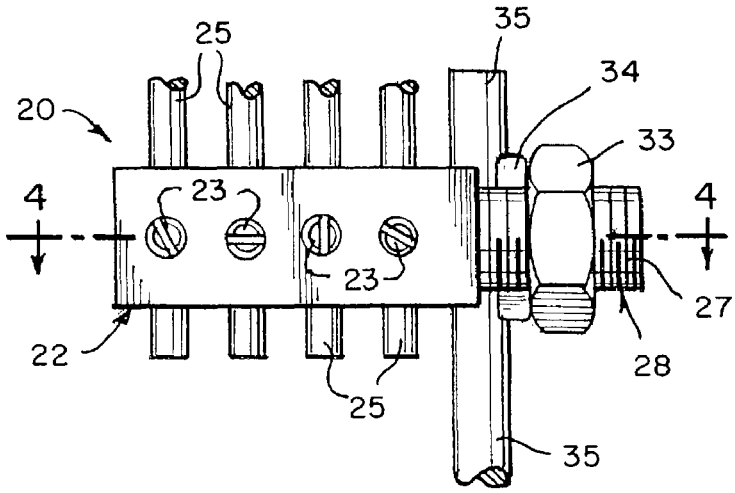
FIG. 2 is a top view of the intersystem grounding bridge shown in FIG. 1.

Referring to FIG. 1, there is shown an exploded perspective view of a first embodiment of an intersystem grounding bridge 20 according to the present invention. The intersystem grounding bridge includes an elongated housing 22 made of an electrically conductive material such as copper, the elongated housing having a plurality of channels or holes 24 formed therein, each channel dimensioned for receiving and holding a grounding wire/conductor 25. The elongated housing also includes a corresponding plurality of threaded apertures 26 each aperture dimensioned for receiving a threaded set screw 23. The set screws when positioned within the threaded apertures are able to secure the corresponding grounding wire/conductor within the corresponding channel 24 as illustrated in FIG. 2.

Figure 3:
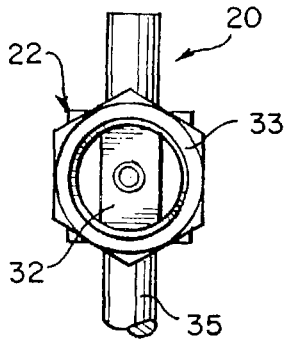
FIG. 3 is an end view of the intersystem grounding bridge shown in FIG. 1 taken along line 3-3 of FIG. 1.
Figure 4:
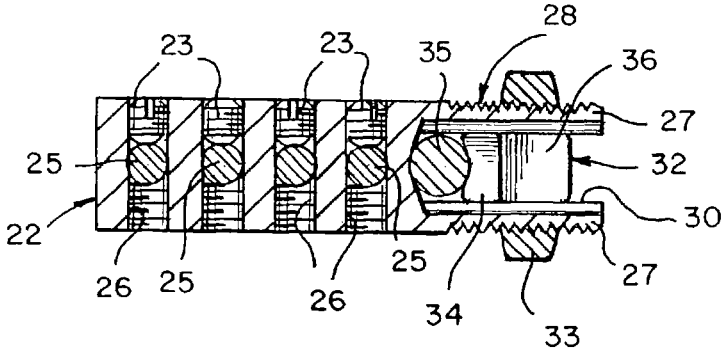
FIG. 4 is a cross-sectional view of the intersystem grounding bridge taken along line 4-4 of FIG. 2.
Figure 5:
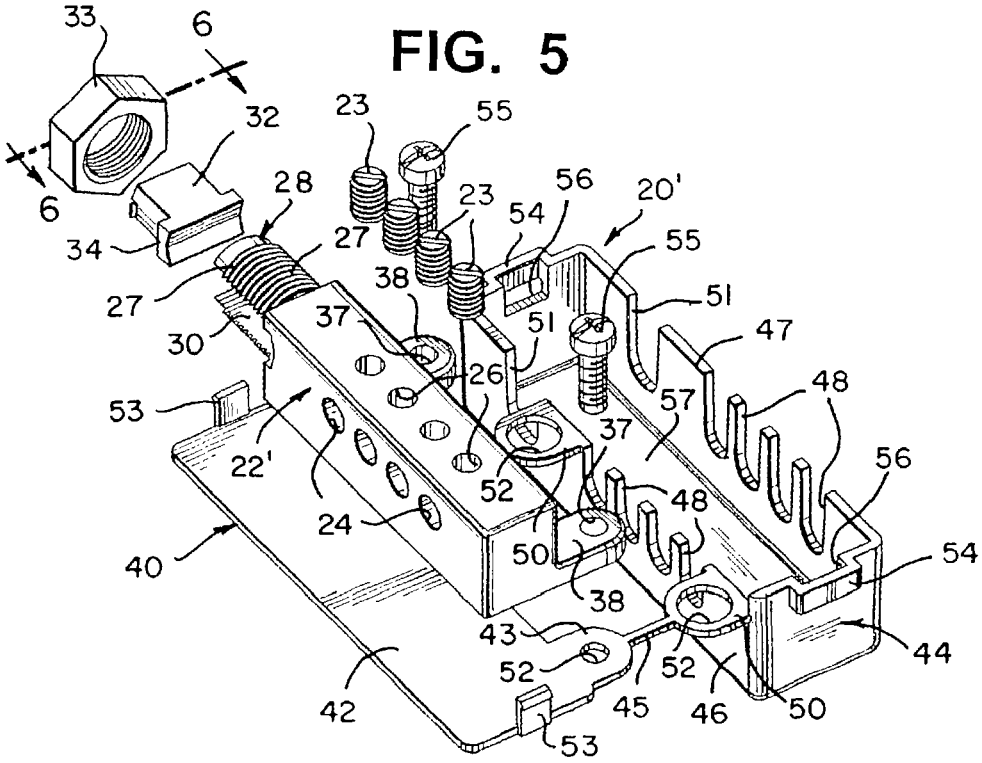
FIG. 5 is an exploded perspective view of a second embodiment of an intersystem grounding bridge according to the present invention.
Figure 6:
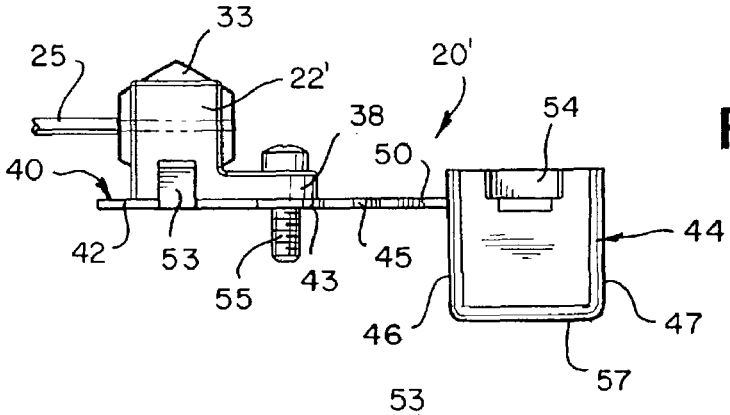
FIG. 6 is an end view of the intersystem grounding bridge taken from the split-bolt portion end of the intersystem grounding bridge, showing the grounding bridge with a grounding rod/conductor positioned therein.

The elongated housing 22 further includes a split-bolt portion 28 which extends substantially in line with an elongated axis 29 of the elongated housing 22. The split-bolt portion is formed by first and second threaded members 27 dimensioned for receipt of a fastening nut 33. The threaded members of the split-bolt portion 28 define an open ended slot 30 which is dimensioned for receiving a grounding rod/conductor 35 of a typical electrical power installation to a building. To secure the grounding rod/conductor within the open ended slot 30, a pressure bar 32 may be positioned adjacent the fastening nut 33. The pressure bar has a bottom portion 34 which preferably has a curved surface complimentary to the exterior curved surface of the grounding rod conductor 35. The pressure bar is dimensioned for fitting within the interior space of the fastener 33, thereby allowing the pressure bar to secure the grounding rod/conductor to the intersystem grounding bridge 20 when the fastener nut is threadedly engaged on the split-bolt portion 28 of the elongated housing 22, as best seen in FIGS. 2, 3, and 4. Alternatively, the fastening nut 32 may directly secure the grounding rod conductor 35 within the split bolt portion 28.

The intersystem grounding bridge is thereby able to readily accept grounding wires/conductors 25 of communication equipment for bonding to the elongated housing so as to be electrically grounded via the elongated housing to the grounding rod/conductor 35 of an electrical power installation when the latter is installed to the grounding bridge. This thereby provides for efficient electrical bonding of communication equipment to the electrical power grounding rod/conductor as required by National Electrical Code 250.94.

Figure 7:
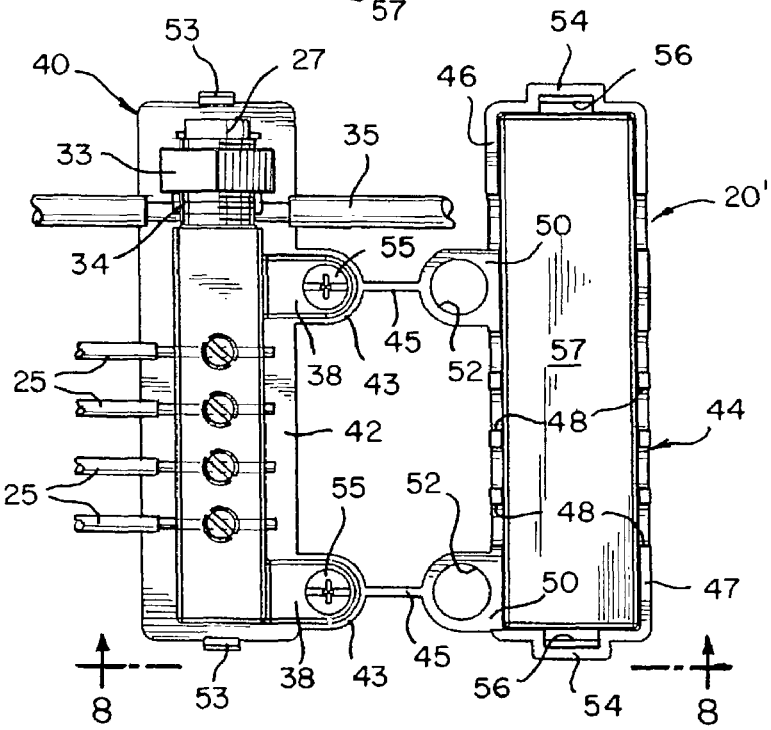
FIG. 7 is a top view of the intersystem grounding bridge with a grounding rod/conductor installed in the split-bolt portion of an elongated housing of the intersystem grounding bridge, as well as illustrating grounding wires/conductors installed therein which are associated with communication system components.
Figure 8:
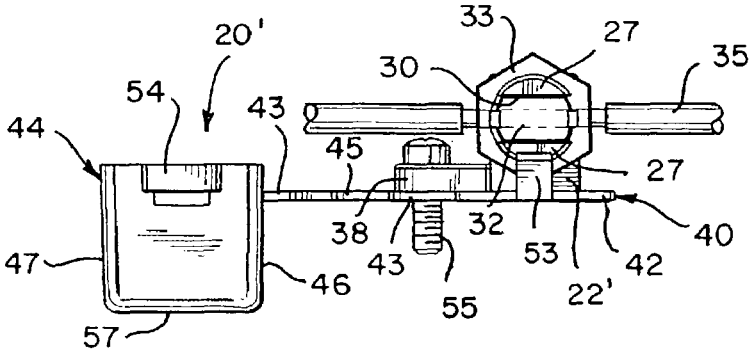
FIG. 8 is an end view of the intersystem grounding bridge taken along line 8-8 of FIG. 7.

FIGS. 5-11 illustrate another embodiment of the intersystem grounding bridge 20' according to the present invention. As shown, the intersystem grounding bridge 20' may further comprise a protective structure 40 which includes a mounting plate 42 and a cover 44. The mounting plate and cover are preferably flexibly secured to each other by a pair of fingers 45 as best seen in FIG. 7. The mounting plate is dimensioned to receive the elongated housing 22 so as to extend completely around the lower surface of the housing as best seen in FIGS. 7, 8, and 10B. The mounting plate includes a pair of feet 43 having apertures 52 which align with apertures 37 in feet 38 of the elongated housing 22'.

Figure 9:
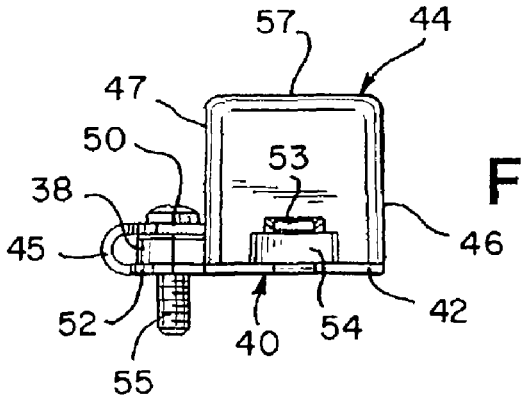
FIG. 9 is an end view of the intersystem grounding bridge from the orientation shown in FIG. 6, illustrating the protective structure in its closed configuration.
Figure 10A:
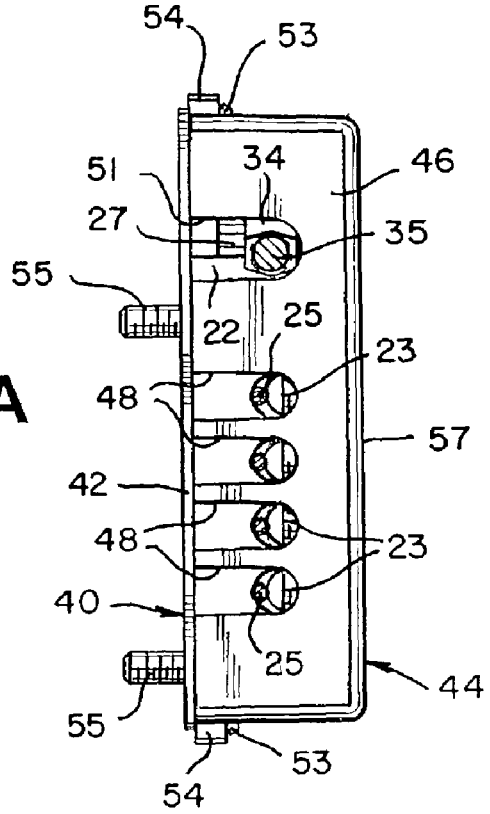
FIGS. 10A, 10B, and 10C are respectively left side, top, and right side views of the intersystem grounding bridge shown in FIG. 5 with the protective structure cover over an associated mounting plate so as to enclose the elongated housing.
Figure 10B:
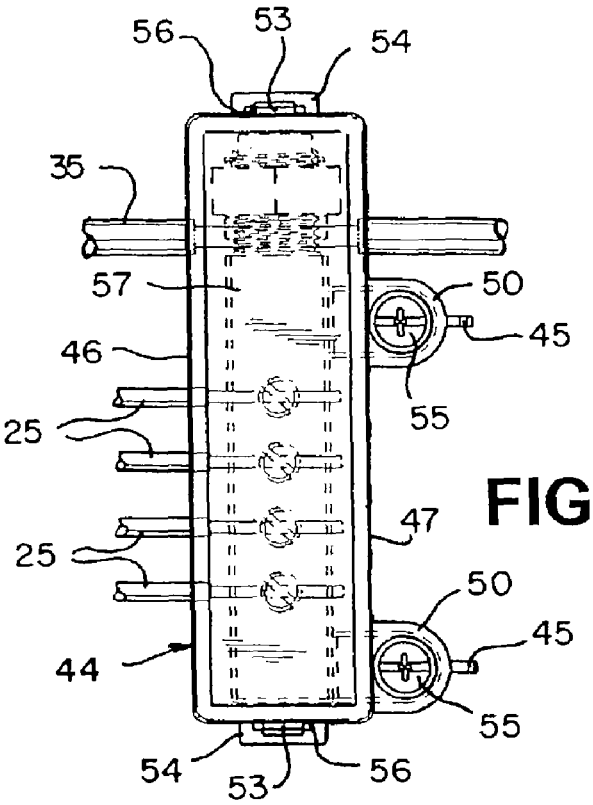
Figure 10C:
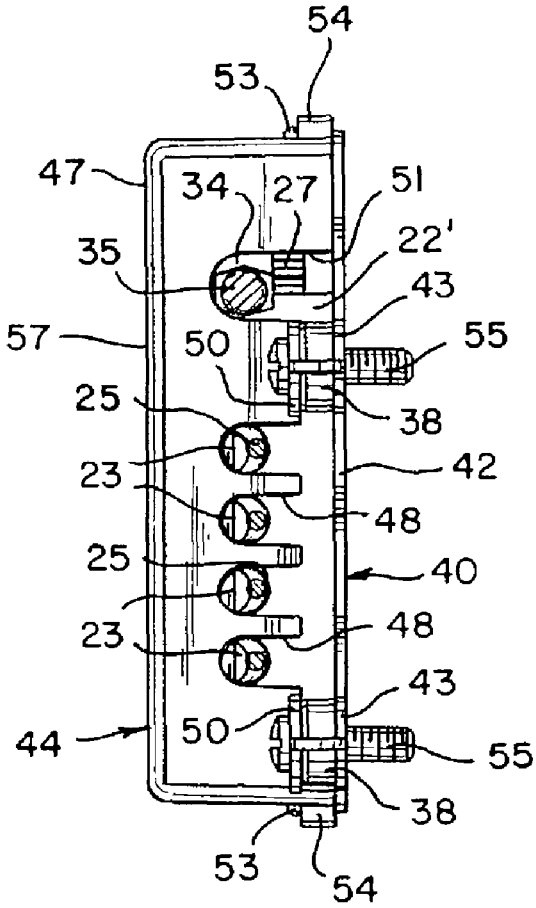

Cover 44 has side walls 46 and 47, with the side walls having cutouts 48 aligned with cutouts on the other side wall so as to allow for passage of conductors 25 as best seen in FIGS. 10A, 10B, and 10C. In addition, side walls 46 and 47 each have a single large cutout 51 for passage of the grounding rod/conductor 35 as also seen in FIGS. 10A, 10B, and 10C. The cover also includes a top wall 57 and a pair of feet 50 with apertures 52 formed therein so that when cover 44 is positioned over mounting plate 42, the apertures 52 are large enough to allow for passage of mounting screws 55 as best seen in FIGS. 9, 10B, and 11.

Figure 11:
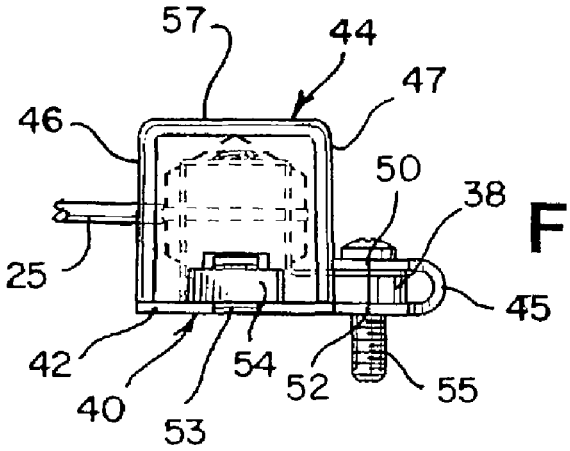
FIG. 11 is an end view of the intersystem grounding bridge taken along lines 11-11 of FIG. 10B, with the protective structure over the mounting plate and showing in phantom a grounding wire/conductor installed in a channel of the plurality of channels of the elongated housing.

Furthermore, mounting plate 42 includes a pair of upstanding flexible tabs 53 which are positioned so as to pass through passageways 56 formed in extending members 54 of cover 44 as best seen in FIGS. 9, 10B, and 11. In this manner, when the cover is positioned over the mounting plate, it is secured to the mounting plate, thereby effectively providing a protective structure around the elongated housing 22 of the intersystem grounding bridge 20.

Preferably, protective structure 40 is made from a non-conductive flexible material, such as a thermoplastic material.

The embodiment of the intersystem grounding bridge as shown in FIGS. 5-11 allows for easy attachment of the intersystem grounding bridge via mounting screws 55 to the outside of a structure (building) to which the grounding rod/conductor 35 and the associated grounding wires/conductors 25 of communication equipment are to be bonded together. Such is typically required by the National Electrical Code as exemplified by section 250.94.

Therefore, the overall construction of the present invention allows for easy bonding of grounding wires/conductors associated with communication equipment to the grounding rod/conductor typically associated with electrical power installation to a building.

While there have been shown and described and pointed out fundamental novel features of the invention as applied to preferred embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto. Furthermore, in the claims means-plus-function clauses are intended to cover the structures described herein as performing the recited function and not only structural equivalents, but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. An intersystem grounding bridge comprising:

an elongated housing formed from electrically conductive material, the housing having:

a plurality of channels formed therein spaced along an elongated axis of said housing, each channel of the plurality of channels dimensioned for receiving and holding a grounding wire/conductor associated with a communication system component, a plurality of threaded apertures, each threaded aperture of the plurality of threaded apertures in cooperating association with one of said channels and dimensioned for receiving a threaded set screw for enabling said set screw to be advanced into securing engagement with a grounding wire/conductor inserted in said channel, and a split bolt portion extending substantially in line with the elongated axis of the housing, the split bolt portion having an open ended slot formed therein dimensioned for receiving a grounding rod/conductor and further having threads formed on an outer surface thereof dimensioned for receiving a threaded fastener for enabling the fastener to secure a grounding rod/conductor to the split bolt portion.

2. The intersystem grounding bridge according to claim 1, further comprising a pressure bar having a bottom portion with an outer surface dimensioned for contacting a grounding rod/conductor in the slot of the split bolt portion, the pressure bar dimensioned for fitting within a fastener so as to securely fasten a grounding rod/conductor within the slot of the split bolt portion.

3. The intersystem grounding bridge according to claim 2, wherein the elongated housing further comprises a plurality of feet attached to a bottom wall of the elongated housing so as to be in the same plane as the bottom wall, each foot having an aperture dimensioned for receipt of a fastener so as to allow securement of the intersystem grounding bridge to a structure.

4. The intersystem grounding bridge according to claim 3, further comprising a protective structure having:

a mounting plate dimensioned for contact with the bottom wall of the elongated housing, and a cover including a top wall and first and second side walls, each side wall having a plurality of cutouts formed therein so as to allow each grounding rod/conductor inserted in a channel of the elongated housing to pass through a cutout when the cover is positioned so that its side walls are adjacent the mounting plate of the protective structure and its top wall is positioned over the elongated housing.

5. The intersystem grounding bridge according to claim 4, wherein the mounting plate of the protective structure has a pair of upstanding flexible tabs.

6. The intersystem grounding bridge according to claim 5, wherein the mounting plate of the protective structure includes apertures formed therein for alignment with the apertures formed in the feet of the elongated housing so as to secure both the mounting plate and the elongated housing to a structure.

7. The intersystem grounding bridge according to claim 6, wherein the cover includes a pair of extending members formed on opposite faces of the cover, each extending member defining a passageway therethrough that is dimensioned for passage of one of said flexible tabs of the mounting plate therethrough, thereby allowing the cover to be secured to the mounting plate when positioned over the elongated housing.

8. The intersystem grounding bridge according to claim 7, wherein the cover further comprises a pair of feet, each having an aperture formed therein and positioned so as to be in alignment with the apertures in the feet of the elongated housing and the apertures in the mounting plate when the cover is positioned over the elongated housing.

9. The intersystem grounding bridge according to claim 8, wherein the protective structure is made of a non-conductive material.

10. The intersystem grounding bridge according to claim 9, wherein the non-conductive material is formed from a thermoplastic material.

11. The intersystem grounding bridge according to claim 4, wherein the protective structure is made from a non-conductive material.

12. The intersystem grounding bridge according to claim 4, wherein the cover is flexibly secured to the mounting plate.

13. The intersystem grounding bridge according to claim 1, wherein the elongated housing further comprises a plurality of feet attached to a bottom wall of the elongated housing so as to be in the same plane as the bottom wall, each foot having an aperture dimensioned for receipt of a fastener so as to allow securement of the intersystem grounding bridge to a structure.

14. The intersystem grounding bridge according to claim 13, further comprising a protective structure having:

a mounting plate dimensioned for contact with the bottom wall of the elongated housing, and a cover including a top wall and first and second side walls, each side wall having a plurality of cutouts formed therein so as to allow each grounding rods/conductors inserted in a channel of the elongated housing to pass through a cutout when the cover is positioned so that its side walls are adjacent the mounting plate of the protective structure and its top wall is positioned over the elongated housing.

15. The intersystem grounding bridge according to claim 14, wherein the mounting plate of the protective structure has a pair of upstanding flexible tabs.

16. The intersystem grounding bridge according to claim 15, wherein the cover includes a pair of extending members formed on opposite faces of the cover, each extending member defining a passageway therethrough that is dimensioned for passage of a tab of the mounting plate therethrough, thereby allowing the cover to be secured to the mounting plate when positioned over the elongated housing.

17. The intersystem grounding bridge according to claim 16, wherein the cover further comprises a pair of feet, each having an aperture formed therein and positioned so as to be in alignment with the apertures in the feet of the elongated housing and the apertures in the mounting plate when the cover is positioned over the elongated housing.

18. The intersystem grounding bridge according to claim 14, wherein the mounting plate of the protective structure includes apertures formed therein for alignment with the apertures formed in the feet of the elongated housing so as to secure both the mounting plate and the elongated housing to a structure.

19. The intersystem grounding bridge according to claim 18, wherein the cover further comprises a pair of feet, each having an aperture formed therein and positioned so as to be in alignment with the apertures in the feet of the elongated housing and the apertures in the mounting plate when the cover is positioned over the elongated housing.

20. The intersystem grounding bridge according to claim 14, wherein the cover is flexibly secured to the mounting plate.

21. An intersystem grounding bridge comprising:

an elongated housing formed from electrically conductive material, the housing having a plurality of channels formed therein spaced along an elongated axis of the housing, each channel of the plurality of channels dimensioned for receiving and holding a grounding wire/conductor associated with a communication system component;

a plurality of threaded apertures, each threaded aperture of the plurality of threaded apertures in cooperating association with one of the channels and dimensioned for receiving a threaded set screw for enabling the set screw to be advanced into securing engagement with a grounding wire/conductor inserted in the channel; and a split bolt portion extending substantially in line with the elongated axis of the housing, the split bolt portion having an open ended slot formed therein dimensioned for receiving a grounding rod/conductor and further having threads formed on an outer surface thereof dimensioned for receiving a threaded fastener; and a protective structure having a mounting plate dimensioned for contact with the bottom wall of the elongated housing, and a cover including a top wall and first and second side walls, each side wall having a plurality of cutouts formed therein so as to allow grounding rods/conductors inserted in the elongated housing to pass through at least some of said cutouts when the flexible cover is positioned so that its side walls are adjacent the mounting plate of the housing structure and its top wall is positioned over the elongated housing.

22. The intersystem grounding bridge according to claim 21, further comprising a pressure bar having a bottom portion with an outer surface dimensioned for contacting a grounding rod/conductor in the slot of the split bolt portion, the pressure bar dimensioned for fitting within a fastener so as to securely fasten a grounding rod/conductor within the slot of the split bolt portion.

23. The intersystem grounding bridge according to claim 21, wherein the elongated housing further comprises a plurality of feet attached to a bottom wall of the elongated housing so as to be in the same plane as the bottom wall, each foot having an aperture dimensioned for receipt of a fastener so as to allow securement of the intersystem grounding bridge to a structure.

24. The intersystem grounding bridge according to claim 23, wherein the mounting plate of the protective structure has a pair of upstanding flexible tabs.

25. The intersystem grounding bridge according to claim 24, wherein the mounting plate of the protective structure includes apertures formed therein for alignment with the apertures formed in the feet of the elongated housing so as to secure both the mounting plate and the elongated housing to a structure.

26. The intersystem grounding bridge according to claim 25, wherein the cover includes a pair of extending members formed on opposite faces of the cover, each extending member defining a passageway therethrough that is dimensioned for passage of one of said flexible tabs of the mounting plate therethrough, thereby allowing the cover to be secured to the mounting plate when positioned over the elongated housing.

27. The intersystem grounding bridge according to claim 26, wherein the cover further comprises a pair of feet, each having an aperture formed therein and positioned so as to be in alignment with the apertures in the feet of the elongated housing and the apertures in the mounting plate when the cover is positioned over the elongated housing.

28. The intersystem grounding bridge according to claim 21, wherein the cover is flexibly secured to the mounting plate.

29. The intersystem grounding bridge according to claim 21, wherein the protective structure is made from a non-conductive material.

* * * * *